United States Patent [19]

Lincke

[11] Patent Number: 4,744,394

[45] Date of Patent: May 17, 1988

[54] WEFT YARN STORE FOR LOOMS

[75] Inventor: Paul Lincke, Kollbrunn, Switzerland

[73] Assignee: Sulzer Brothers Limited, Winterthur, Switzerland

[21] Appl. No.: 46,151

[22] Filed: May 5, 1987

[30] Foreign Application Priority Data

May 23, 1986 [CH] Switzerland ..... 02103/86

[51] Int. Cl.[4] ..... B65H 47/01

[52] U.S. Cl. ..... 139/452; 242/47.12; 242/47.01; 66/132 R

[58] Field of Search ..... 139/450, 452; 242/47.01, 47.11, 47.12; 66/132 R

[56] References Cited

U.S. PATENT DOCUMENTS

| | | | |
|---|---|---|---|
| 3,411,548 | 11/1968 | Pfarrwaller . | |
| 3,759,455 | 9/1978 | Clemens . | |
| 4,033,384 | 7/1977 | Waeger | 139/452 |
| 4,407,336 | 10/1988 | Steiner . | |
| 4,623,005 | 11/1986 | Svaty | 139/452 |

FOREIGN PATENT DOCUMENTS

| | | | |
|---|---|---|---|
| A0148356 | 7/1985 | European Pat. Off. . | |
| 3123760A1 | 2/1982 | Fed. Rep. of Germany . | |
| 231848 | 11/1985 | Japan | 139/452 |
| A439161 | 12/1967 | Switzerland . | |

*Primary Examiner*—Henry S. Jaudon

*Attorney, Agent, or Firm*—Burns, Doane, Swecker & Mathis

[57] ABSTRACT

A loom left yarn store receives yarn being supplied from a weft package (5) and makes the stored yarn supply available to be drawn off from the store intermittently for picking into the shed of a loom. The store includes a stationary drum (11) which is supported by way of its outer periphery and which is adapted to receive a yarn supply (51) to be stored. A winding element (14) rotates around the drum periphery (111) and has an element (142) for entraining the weft yarn (52). One or more yarn entraining elements (142) can be brought into and out of operation in accordance with a program and when in operation can wind yarn on the drum periphery (111). The drum (11) is supported by way of its outer periphery horizontally by magnets or vertically by means of brushes. The winding element (14) is a ring which rotates continuously around the drum periphery and from which at least one pin (142) engages periodically in a recess (111) in the drum. The store contains few mechanical means and the retaining or securing elements (142, 152) requiring intermittent actuation are of reduced mass.

15 Claims, 6 Drawing Sheets

WEFT YARN STORE FOR LOOMS

FIELD OF THE INVENTION

The invention relates to a loom weft yarn store for receiving yarn from a weft package and permitting lengths of such yarn to be drawn off intermittently for picking into the shed of the loom.

BACKGROUND OF THE INVENTION

DE-OS No. 2 335 204 discloses a weft yarn store whose function is merely to prepare a sufficient supply of yarn for picking but not to size the yarn according to cloth width. A store of such a kind would be unsuitable, for instance, for use in air jet looms since the weft yarn must have a definite length during picking to obviate any substantial excess of yarn on the catching side of the loom after picking.

Other proposals for loom weft yarn stores have sought to deal with the matter of pick length, but the structures proposed have left room for improvement. High speed loom operations impose unusual demands on modern yarn handling systems.

SUMMARY OF THE INVENTION

It is an object of this invention to provide a yarn store which, in addition to its storage ability, can in a simple manner ensure that a freely selectable length of wound-on yarn supply is available which can be removed from the store at a required time.

According to the invention, a stationary drum is supported by way of its outer periphery and is adapted to receive a yarn supply to be stored. Winding means rotates around the drum periphery and carries one or more yarn entraining elements that can be brought into and out of cooperative relationship with respect to the drum periphery in accordance with a program. The outer periphery of the drum is supported, for example, by means of magnets or brushes, for example, at conical ends of the drum, the drum also being restrained against rotation.

The winding means may be in the form of a rotating ring extending around the drum periphery and from which at least one entraining pin can engage periodically in a recess in the surface of the drum.

Yarn guide means are disposed before and after the drum on the axis thereof to ensure that the yarn runs on to and off from the conical end parts of the drum.

Mounted on a stationary part of the frame is at least one controllable yarn retaining element disposed adjacent the drum periphery after the yarn entraining ring, as considered in the direction of yarn movement. This yarn retaining element is movable toward and away from the drum periphery so that it may selectively contact the yarn at the drum periphery. This arrangement permits one portion of the yarn to be held stationary with respect to the drum while other portions are being wound around the drum by the action of the rotating yarn entraining element. Use of the retaining element helps to wind the coil of yarn on to and off the drum.

Another controllable yarn retaining element can be disposed before the storage ring in order to retain a stored supply of yarn on the drum. In a special embodiment of this arrangement, the yarn retaining elements disposed before and after the storage ring are also devised as means for the mounting of the drum.

The store described is of use, for example, for gripper looms and air jet looms. It is suitable for single-weft or multiple-weft operation. The invention is noteworthy for its reduced outlay on mechanical means and for the low masses of the intermittently actuated elements for entraining and retaining the weft yarn.

BRIEF DESCRIPTION OF THE DRAWINGS

The invention will be described in detail hereinafter with reference to the drawings wherein:

FIGS. 2 and 2*a* are views to a reduced scale and looking along the drum axis to show the arrangement of the bearing elements for the drum;

DETAILED DESCRIPTION OF PREFERRED EMBODIMENTS

Figure 1:
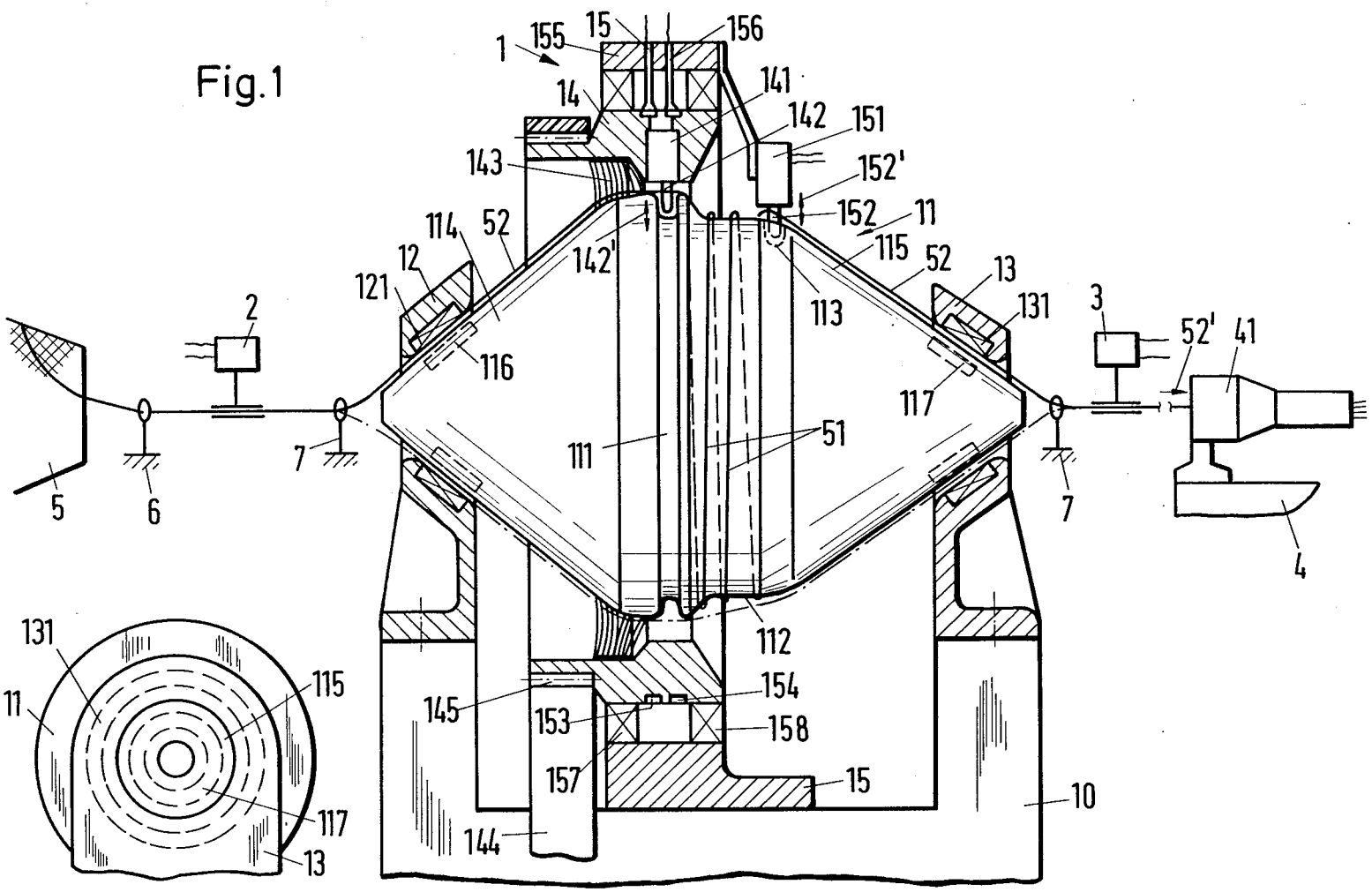
FIG. 1 is a view in a meridian section of a weft yarn store embodying features of the invention.

Conventionally, a weft yarn store 1 is disposed between a weft yarn package 5 and a loom 4. The store 1 comprises a drum 11 mounted on a frame 10 through bearings 12 and 13. The drum 11 has a conical front part 114 and a conical rear part 115, and guiding eyes 6, 7 are provided opposite the ends of these parts of the drum to guide the weft yarn passing to and from the drum.

Figure 2:
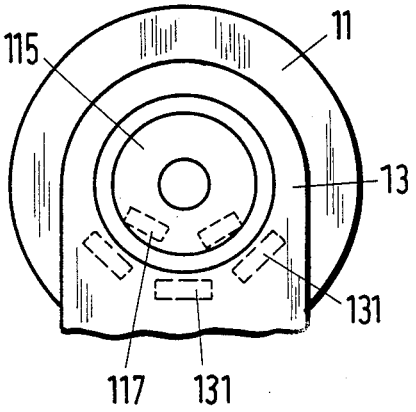

The parts 114, 115 have, if the drum is mounted magnetically, magnetic inserts 116, 117 which can either be distributed around the periphery, as shown in FIG. 2, or be devised in rotational symmetry, as shown in FIG. 2*a*.

Beyond the yarn guides 6 and 7 in the weft yarn path, there are yarn braking devices or stoppers 2 and 3 which can be actuated to clamp against the yarn and prevent movement thereof. These are operated in timed relation to loom picking.

Around the drum 11 is a winding ring 14 which carries one or more magnet windings 141 from which pins 142 can move, as indicated by a double arrow 142', into a groove 111 in the drum 11. The groove 111 merges into a cylindrical part 112 operative to locate the weft yarn accurately on the drum with the co-operation of the pin 142. Further, the part 112 merges to the right in FIG. 1, as considered in the direction of yarn movement, into a recess 113 in the drum periphery. An electromagnet 151 is mounted on the stationary frame adjacent the recess 113 in the drum 11 and operates a pin 152 movable, as indicated by a double arrow 152', into and out of the recess 113.

The magnet pin units 141–142 and 151–152 can be distributed in any required number over the drum periphery, it being understood of course that for each retainer pin 152 used, there must also be a cooperating recess portion 113 in the periphery of the drum 11.

The magnets 141 and 151 can be energized by a control facility 43 by way of connecting lines, contact ways or tracks 153, 154 and rubbing contacts 155, 156.

Instead of magnetic means for actuating the pins 142, 152, other motive means such, for example, as pneumatic adjusting drives can be provided if desired.

A brush 143 can be disposed on the ring 14, the brush resting lightly on the drum periphery and ensuring a defined weft yarn tension during yarn movement. An arrow 52 indicates the direction of weft yarn movement. The ring 14 is associated with a pulley 145 driven by way of a belt 144. Ring 14 is mounted in ring bearing 15 with the interposition of bearings 157, 158.

The drum bearings 12, 13 are operative by way of magnets 121, 131 respectively on the magnetic inserts 116, 117 in the drum 11. The magnets can be distributed over just some of the drum periphery, as shown in FIG. 2, or can be distributed all the way around such periphery. Bearing forces are produced by oppositely directed magnetic fields of the magnets 131, 121 and of the inserts 117, 116 respectively. Also, in the arrangement of FIG. 2 the magnets can restrain or secure the drum against rotation.

It will be helpful to describe now the operation of the weft yarn store depicted in FIG. 1.

FIG. 1 shows the operative position of the store near the end of the storage step and shortly before picking. Yarn brake 2 is open whereas yarn brake 3 is in the closed state. The pins 142, 152 are in their respective bottom positions in engagement with the drum 11.

For removal of the yarn from the store the brake 3 opens and the brake 2 closes. The magnet 141 and the magnet 151 (or, if a number of each such magnets is provided, the magnets) hold the pins 142, 152 back during picking, so that the weft yarn supply on the store can be drawn off by a main nozzle 41 until the weft yarn extends along a meridian line of the drum 11.

As previously stated, however, picking can be by a gripper element.

In multi-weft operation the stored yarn coil 51 can be retained on the drum periphery for as long as required, the pins 152 remaining in engagement whereas the pins 142 must be withdrawn into the ring 14. For multiweft operation the storage function must be coordinated by the facility 43 with the pattern control of the loom, for example, by way of the control of shedding motion 42.

Instead of a drive comprising the belt 144 and pulley 145, for example, a compact disc rotor motor can be disposed around the drum periphery.

The magnets 141, 151 can be controlled to retain the winding by means of a weft yarn detector 44 in association with the control facility 43, thus ensuring that the length of weft yarn stored on the drum 11 is of the correct size.

Figure 3:
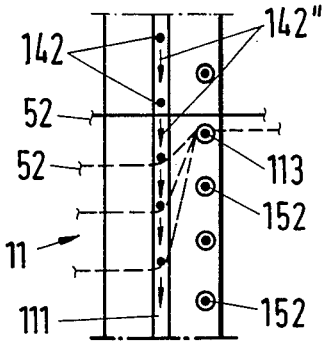
FIG. 3 is a view of a part of the drum periphery near the elements for entraining and retaining the yarn.

FIG. 3 shows how, after the pins 142, 152 have engaged, the weft yarn is deposited from the extended solid-line position on the drum periphery. The chain-line positions of weft yarn represent the position thereof at short intervals of time during which the pins 142 advance in the arrowed direction.

Figure 5:
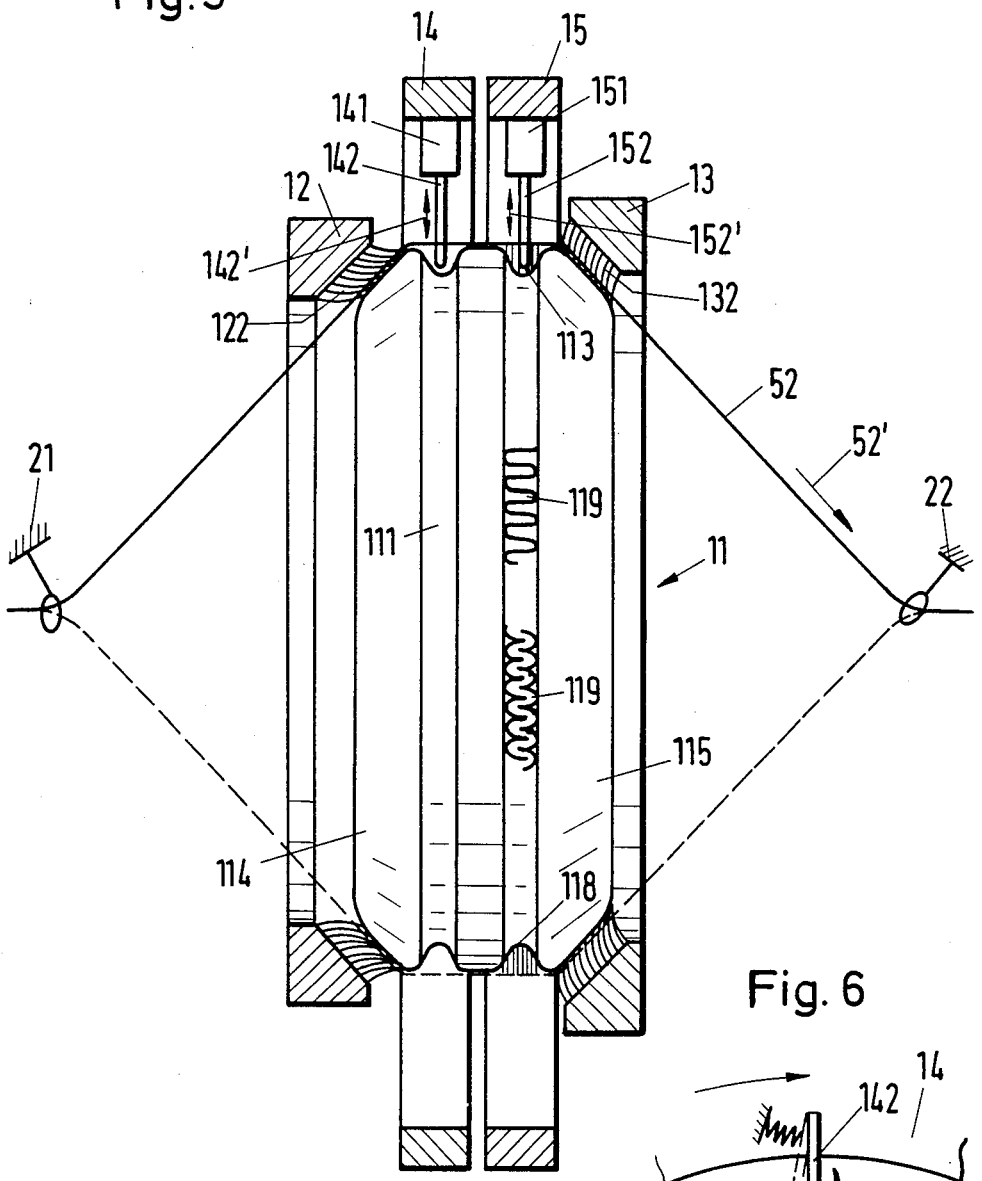
FIG. 5 is a view similar to FIG. 1 of a variant.

FIG. 5 shows a simplified construction of the weft yarn store in which the drum 11 is mounted by means of brushes 122, 132 in bearings 12, 13 respectively. Yarn-guiding eyes 21, 22 cause the weft yarn 52 to describe a cone as it is wound on and off the drum.

In FIG. 5 the recess 113 is in the form of a groove receiving a brush 118 or webs 119. This feature prevents layers of weft yarn from sliding into the groove 113. Also, this construction permits a partial positional variation of the drum, for example, a rotation around its axis, which is permissible with rugged weft yarns.

Figure 6:
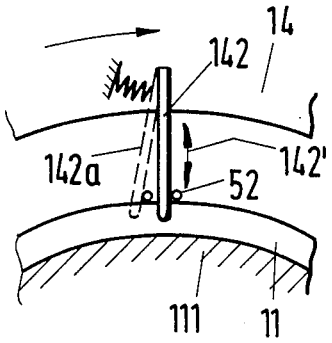
FIG. 6 is a detail view of a yarn entrainer.

As shown in FIG. 6, the pin 142 is, with advantage, resilient in order to obviate peaks of weft tension when the pin 142 entrains the weft yarn abruptly.

Figure 7:
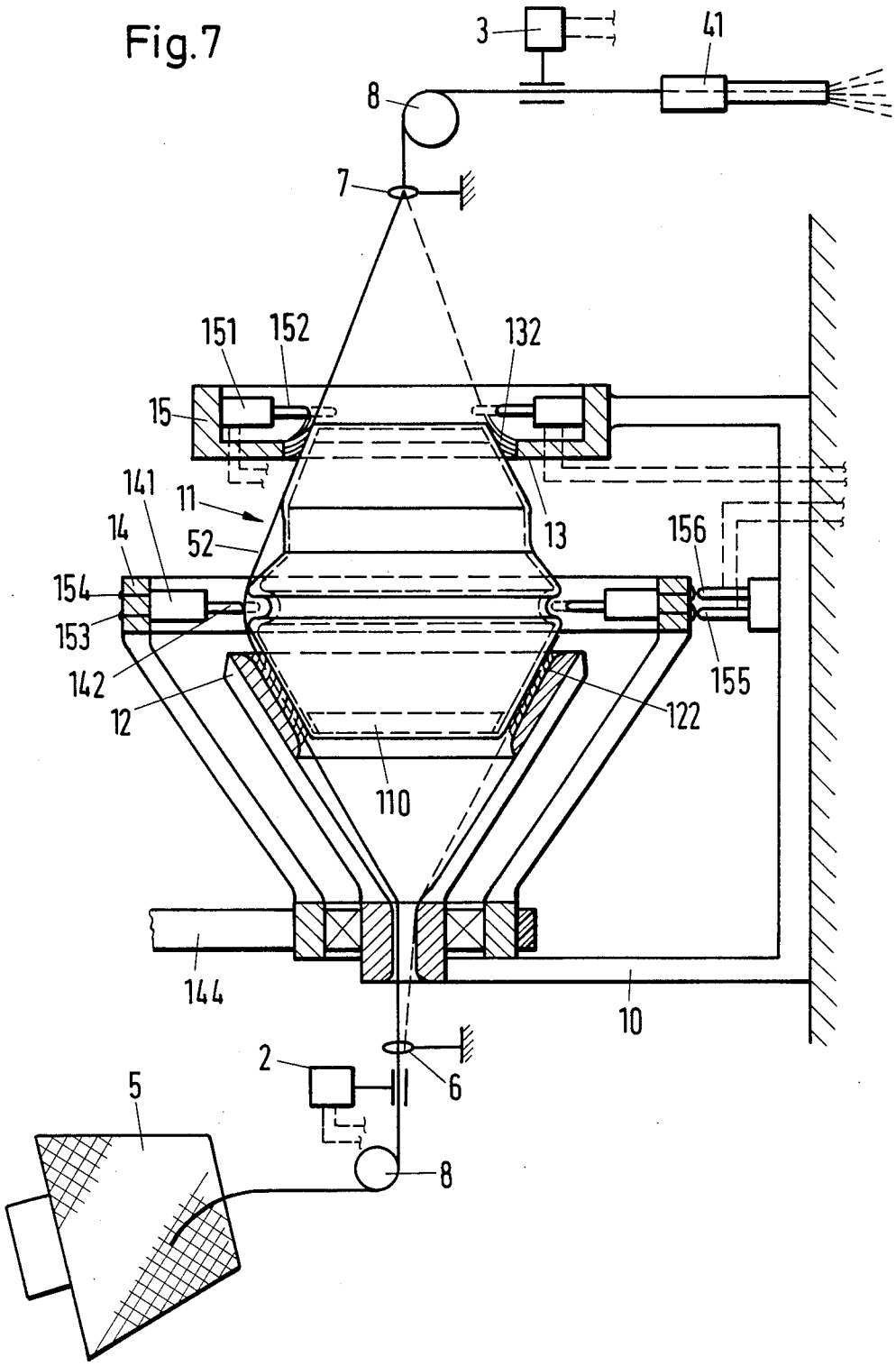
FIG. 7 shows an arrangement in which the drum axis is vertical.

When the drum 11 is arranged vertically, it is carried by a brush 122 as shown in FIG. 7. The pressure with which the drum 11 bears on the brush 122 can be adjusted as required by means of a replaceable weight 110. The advantage of the vertical mounting of the drum 11 is that when the yarn is drawn off the top of the drum, no appreciable friction needs to be overcome between the brush 132 and the drum 11. The brush 132 is operative in this case merely to retard the weft yarn while it is being drawn off and to center the drum 11. When the drum is mounted vertically, a deflecting element 8 deflects the weft yarn towards the main nozzle 41.

Figure 4:
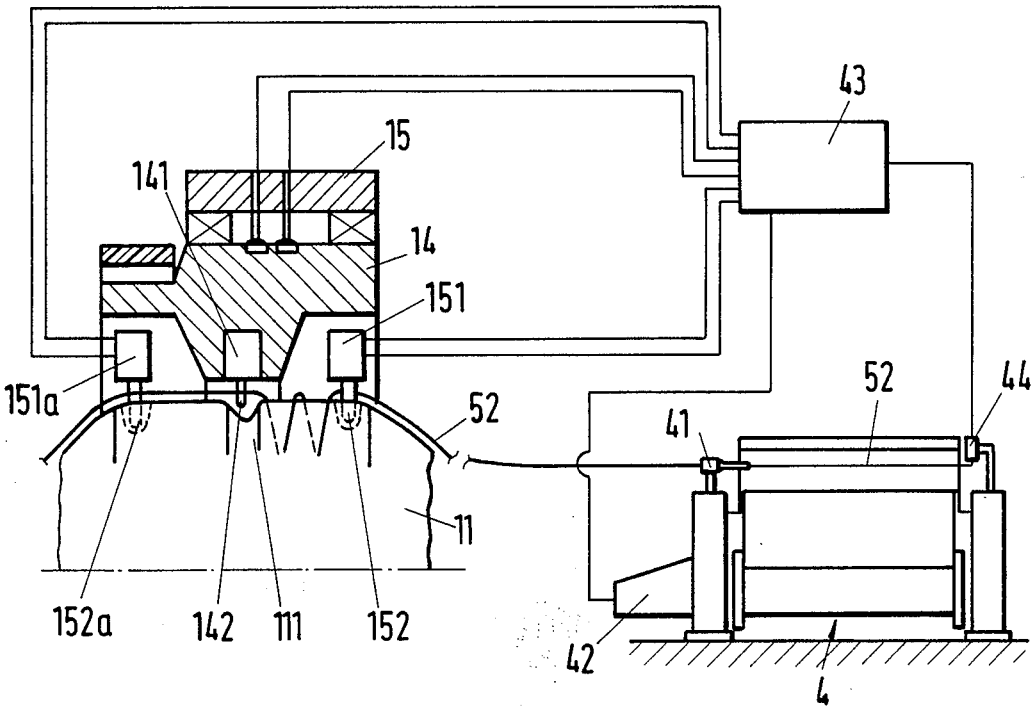
FIG. 4 is a view in a meridian section which shows these elements together with their control and/or actuation in association with the loom.

When a store is used for multiweft operation, a further magnet 151*a* is, conveniently, disposed before the winding ring 14, as considered in the weft direction, to retain the coil of weft yarn on the intake side. The magnet 151*a* is energized after the completion of winding as indicated by disengagement of the pin 142 from the groove 111 in FIG. 4.

Figure 8A:
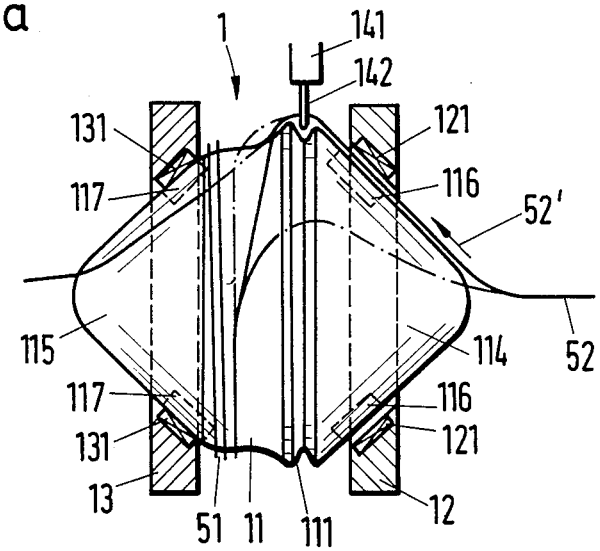
FIGS. 8*a* and 8*b* show a magnetic mounting for the drum with alternate support thereof at either end.
Figure 8B:
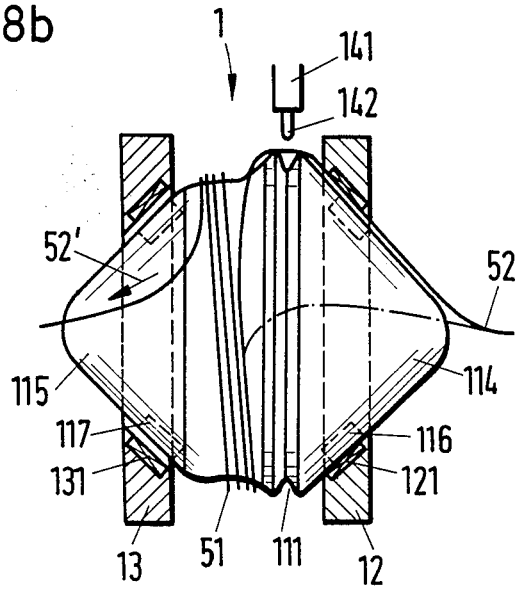

FIGS. 8*a* and 8*b* show an arrangement wherein the drum 11 can be drawn, for example, by ring magnets 121, 131, alternately into the drum bearings 12, 13 at the left-hand and right-hand ends respectively of the drum. In this case the bearings 12, 13 have the same function as the pins 152, 152*a* which are intended to prevent the yarn coil 51 from slipping off the drum.

Figure 9A:
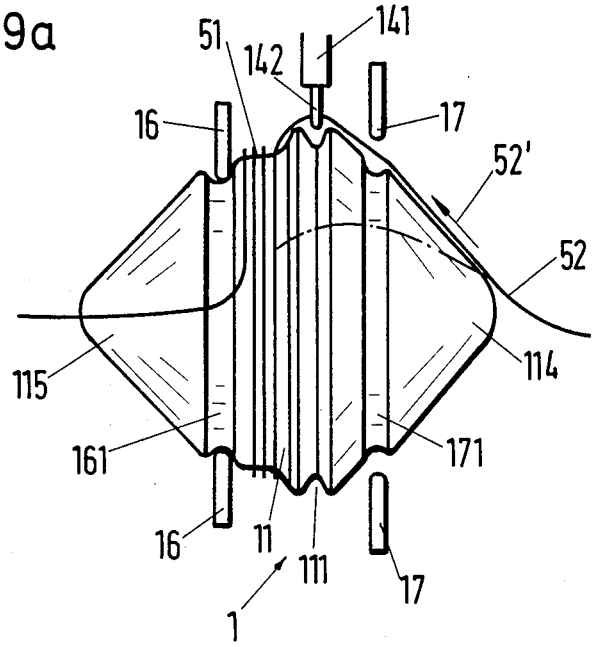
FIGS. 9*a*, 9*b* and 9*c* show controllable bearing elements which retain the drum alternately.
Figure 9C:
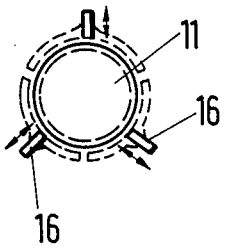
Figure 9B:
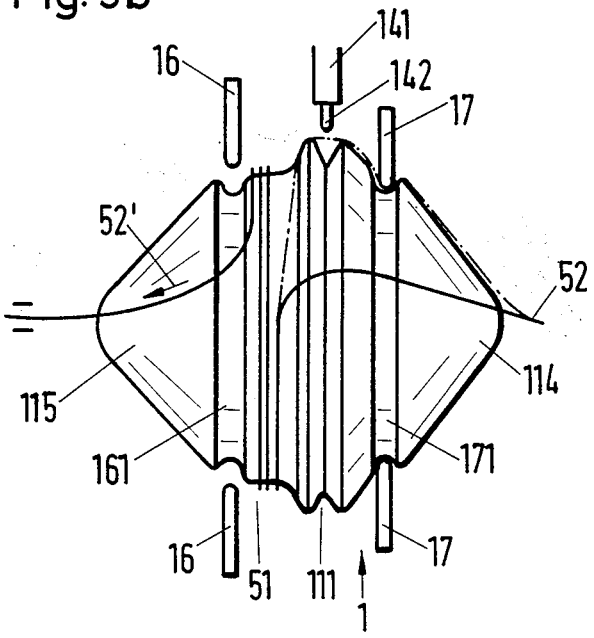

In another embodiment, shown in FIGS. 9*a* and 9*b*, instead of ring magnets 121 and 131, clamping claws 16 and 17 are disposed in the drum bearings 12 and 13 and are engageable in programmed manner in grooves 161 and 171 in the drum 11 to retain the same and also to secure the weft yarn 52 on the drum periphery. FIG. 9*c* is a view looking axially of the drum to show how the claws 16 are disposed relatively thereto. The claws can be added segments, as shown in chain lines in FIG. 9*c*, so that the drum 11 can be retained over its whole periphery.

The drum 11 is made preferably of plastic which can be covered with a wear-resistant layer, for example, of chromium.

While certain embodiments of the invention have been illustrated and described herein, other modifications and variations are possible, and it is intended that the scope of the invention be ascertained from the following claims.

What is claimed is:

1. A loom weft yarn store for receiving yarn from a weft package and making lengths of such yarn available intermittently for picking into the shed of a loom, comprising a stationary drum supported by way of its outer periphery and adapted to receive a yarn supply to be stored, winding means rotatable around the periphery of said drum, said winding means including at least one yarn entraining element movable between a first position in which it is spaced radially away from the periphery of said drum and a second position in which it is disposed close to the periphery of said drum to contact a weft yarn located on said periphery and move the contacted yarn portion about said periphery during rotation of said winding means, and means for selectively moving said yarn entraining element between said first and second positions in accordance with a program.

2. A store according to claim 1, wherein said winding means includes a plurality of said yarn entraining elements are disposed around the periphery of said drum.

3. A store according to claim 1, including magnets for supporting said drum by way of its outer periphery.

4. A store according to claim 1, including brushes for supporting said drum by way of its outer periphery.

5. A store according to claim 1, wherein said drum is supported at least at one end and is restrained against rotation.

6. A yarn store according to claim 5, wherein the axis of said drum is generally vertical, wherein yarn passes from said weft package to the lower end portion of said drum, and wherein means are provided for contacting the periphery of said lower end portion to support said drum.

7. A yarn store according to claim 6, additionally including centering means surrounding an upper end portion of said drum and including brush means for yieldingly contacting the periphery of said drum.

8. A yarn store according to claim 6, wherein said means for contacting the periphery of the lower end portion of the drum includes brush means yieldingly engaging said periphery, wherein said drum bears downwardly on said brush means, and wherein interchangeable weight means is associated therewith to permit adjustment of the pressure between said drum and said brush means.

9. A store according to claim 1, wherein said drum is provided with a circumferential recess in its periphery, and wherein said winding means is a ring which rotates continuously around the drum periphery and carries said at least one yarn entraining element so that the latter can engage periodically in said recess in the periphery of said drum.

10. A store weft yarn store according to claim 1, including yarn stoppers disposed before and after said drum in the weft yarn path from said weft package to said loom, wherein the end portions of said drum are conical in configuration, and wherein yarn guides are disposed near the ends of said drum in approximate alignment with its axis to guide the yarn passing to and from the periphery of said drum.

11. A store according to claim 1, including yarn stoppers disposed before and after the drum in the weft yarn path from said weft package to said loom.

12. A store according to claim 1, wherein said drum is disposed vertically and its front part is supported.

13. A store according to claim 12, wherein a brush-carrying centering ring extends around a rear part of said drum.

14. A store according to claim 12, wherein the front part of said drum has interchangeable weight means associated therewith.

15. A store according to claim 1, wherein the body of said drum comprises plastic material having a wear-resistant covering on its outer periphery.

* * * * *